US005554007A

United States Patent [19]

Watts

[11] Patent Number: 5,554,007

[45] Date of Patent: Sep. 10, 1996

[54] VARIABLE DISPLACEMENT AXIAL PISTON HYDRAULIC UNIT

[75] Inventor: Thomas A. Watts, Ottawa, Ill.

[73] Assignee: Caterpillar Inc., Peoria, Ill.

[21] Appl. No.: 324,199

[22] Filed: Oct. 17, 1994

[51] Int. Cl.[6] ..... F04B 1/30

[52] U.S. Cl. ..... 417/222.1; 91/504

[58] Field of Search ..... 417/218, 222.1; 91/499, 504, 505

[56] References Cited

U.S. PATENT DOCUMENTS

| | | | |
|---|---|---|---|
| 3,157,130 | 11/1964 | Cadiou | 91/6.5 |
| 3,199,461 | 8/1965 | Wolf | 91/6.5 |
| 3,200,761 | 8/1965 | Firth et al. | 91/6.5 |
| 3,382,813 | 5/1968 | Schauer | 91/474 |
| 3,585,901 | 6/1971 | Moon, Jr. | 91/499 |
| 3,727,521 | 4/1973 | Reynolds | 417/222.1 |
| 3,956,969 | 5/1976 | Hein | 91/6.5 |
| 4,518,320 | 5/1985 | Goodell | 417/222.1 |
| 4,918,918 | 4/1990 | Miki et al. | 60/489 |

FOREIGN PATENT DOCUMENTS 62-169269 10/1987 Japan .

*Primary Examiner*—Peter Korytnyk
*Attorney, Agent, or Firm*—John W. Grant

[57] ABSTRACT

A variable displacement axial piston hydraulic unit includes first and second control pockets individually disposed between first and second arcuate shaped fluid passages, a first electrohydraulic valve for controlling fluid flow between the first control pocket and the first fluid passage and a second electrohydraulic valve for controlling fluid flow between the second passage and the second control pocket. A controller outputs first and second control signals to the first and second electrohydraulic valves in response to receiving a command signal so that the tilt angle of a swashplate is controlled to obtain a desired operating parameter. An angle detector, a pressure detector, and a speed detector provide feedback signals to the controller for determining when the desired operating parameter has been obtained.

16 Claims, 4 Drawing Sheets

VARIABLE DISPLACEMENT AXIAL PISTON HYDRAULIC UNIT

TECHNICAL FIELD

This invention relates to a variable displacement axial piston unit and, more particularly, to a pump or motor which utilizes the naturally existing torque moments within the pump or motor for adjusting the swashplate angle.

BACKGROUND ART

Variable displacement axial piston pumps and motors have long been used in industry. The basic axial piston pump and motor includes a rotatable cylinder barrel containing several pistons which reciprocate in mating piston bores more or less parallel to the axis of a drive shaft. One end of each piston is held against a tiltable swashplate. When the swashplate is tilted relative to the drive shaft axis, the pistons reciprocate within their bores and a pumping action occurs. Each piston bore is subjected to two main pressure levels during each revolution of the cylinder barrel. One pressure is a result of the load and is located on one side of the ramp of the tilted swashplate. The other pressure is normally much lower and is located on the other side of the swashplate ramp. As the piston bores sweep past the top and bottom dead center positions, torque moments are generated on the swashplate as a result of the reciprocating pistons and pressure carryover within the piston bores. Pressure carryover is the time delay in pressure rise in the piston bore as the piston bore is going from low to high pressure or the time delay for pressure decay when the piston bore is moving from high to low pressure.

The swashplate is typically controlled using one or more actuators and a bias spring to offset the torque moments. The torque moments are quite high in today's high pressure axial piston units such that the actuators are quite large and may account for approximately 20% of the overall size of the pump or motor. Swashplate response and control response are limited because of the volumes of fluid that need to flow into and out of the hydraulic actuators and the total added inertia of the actuators. Moreover, such actuator system within the pump contributes from about 7–12% of the overall cost of the pump. These costs result from the number of pieces used in the actuators and the precision machining of several large pieces and the expense associated with assembly of the pump or motor.

There have been at least two proposals to control the angle of the swashplate by using the pistons within the cylinder barrel instead of a separate actuation system. One such unit is disclosed in Japanese Utility Model Application No. 61-37882. Another unit is disclosed in U.S. Pat. No. 4,918,918. One of the disadvantages of those disclosures is that the swashplates are controlled hydromechanically. It is believed that at least one operating parameter should be sensed electronically and the output signal processed electronically for adjusting the position of the swashplate of today's high speed units. For example, many of today's pumps rotate at about 2,250 revolutions per minute, which calculates to be about 37.5 revolutions per second. If such pump has 9 pistons, a total of 338 piston bores sweep past each dead center position each second. This means that about 0.003 seconds elapses between consecutive piston bores and the control system has somewhat less than 0.003 seconds to adjust the pressure rise/decay of each piston bore.

Thus, it would be desirable to provide a variable displacement axial piston hydraulic unit with the capability of changing the displacement of the swashplate by modulating the pressure in the piston bores at top and bottom dead center positions of the pistons to thereby modify the force imposed on the pistons as they pass through the top and bottom dead center positions for controlling the swashplate position wherein modulating the pressure is controlled electronically based on at least one operating parameter of the unit.

DISCLOSURE OF THE INVENTION

In one aspect of the present invention, a variable displacement axial piston hydraulic unit includes a rotatable cylinder barrel having a plurality of pistons reciprocating in respective ones of a plurality of equally spaced circumferentially arranged piston bores. A swashplate is tiltably mounted adjacent one end of the cylinder barrel for adjusting the stroke of the pistons. A head assembly has first and second passages, and at least one head pocket defined therein disposed between adjacent ends of the passages. The other end of the barrel is in sliding contact with the head assembly so that the piston bores sequentially communicate with the first passage, the control pocket and the second passage as the barrel rotates. An electrohydraulic valve disposed between the first pocket and one of the first and second passages controls fluid flow therebetween as each piston bore communicates with the control pocket. A control means outputs a control signal to the electrohydraulic valve in response to receiving a command signal so that the tilt angle of the swashplate is controlled to obtain a desired operating parameter.

BEST MODE FOR CARRYING OUT THE INVENTION

Figure 1:
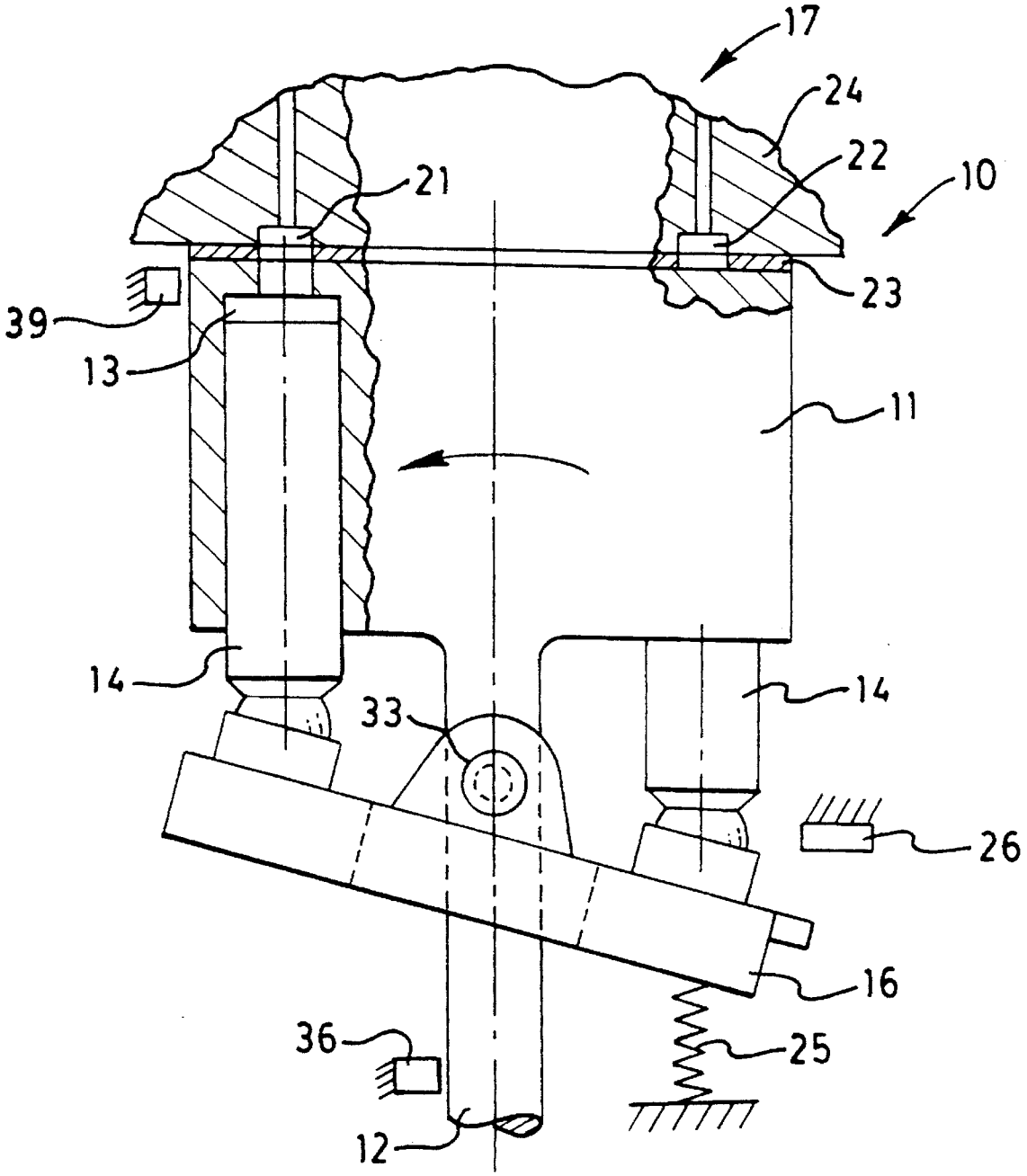
FIG. 1 is a diagrammatic illustration of a variable displacement axial piston hydraulic unit illustrating an embodiment of the present invention.

A variable displacement axial piston hydraulic unit is generally indicated by the reference numeral 10. The hydraulic unit 10 can be either a pump or a motor but in this embodiment, is described as a hydraulic pump having a rotatable cylinder barrel 11 driven by a shaft 12. The cylinder barrel has a plurality of equally spaced circumferentially arranged piston bores, one shown at 13, provided therein. Each of a plurality of pistons 14 are reciprocatably disposed in the respective piston bores 13. A swashplate 16 is conventionally tiltably mounted adjacent one end of the cylinder barrel for adjusting the stroke of the pistons. A head assembly 17 is disposed adjacent the other end of the cylinder barrel and has arcuately shaped low and high pressure passages 18,19 respectively and a pair of control pockets 21,22 defined therein with each pocket being respectively disposed between adjacent ends of the low and high pressure passages. The control pockets 21 and 22 are respectively disposed at regions commonly referred to as top and bottom dead centers. Alternatively, control pockets may be offset from the top and bottom dead centers in some applications. The head assembly conventionally includes a valve plate 23 nonrotatably attached to a head 24 with the passages 18, 19 and the control pockets 21,22 being partially formed in both the valve plate and the head. Alternatively, the valve plate may be omitted wherein the passages and control pockets would be formed solely in the head. The cylinder barrel is conventionally resiliently urged toward the head assembly such that the other end of the barrel is in sliding contact with the valve plate 23 of the head assembly so that the piston bores sequentially communicate with the low pressure passage 18, the control pocket 21, the high pressure passage 19, and the control pocket 22 as the cylinder barrel rotates. A spring 25 resiliently biases the swashplate 16 toward the minimum displacement position established by a stop 26.

An electrohydraulic valve 27 is disposed between the control pocket 21 and the low pressure passage 18 to control fluid flow from the control pocket 21 to the low pressure passage 18 as each piston bore communicates with the control pocket. Similarly, another electrohydraulic valve 28 is disposed between the control pocket 22 and the high pressure passage 19 to control fluid flow from the high pressure passage 19 to the control pocket 22 as each piston bore communicates with the control pocket 22. In this embodiment, the electrohydraulic valves 27,28 are high speed two position valves. Alternatively, the electrohydraulic valves 27,28 can be proportional valves or hydraulic pilot pressure reducing valves.

A command signal generator 29 is provided for outputting a command signal to establish a desired operating parameter of the hydraulic unit. A control means 31 is connected to the command signal generator 29 and to the electrohydraulic valves 27,28 for processing the command signal and outputting first and second control signals to control the electrohydraulic valves so as to control the tilt angle of the swashplate to achieve the desired operating parameter. The control means includes a controller 32, an angle detector 33 operatively connected to the swashplate 16 for outputting a signal to the controller 32 commensurate with the angle of the swashplate, a pressure detector 34 connected to the discharge passage 19 for outputting a signal to the controller 32 commensurate with the pressure level of the fluid in the discharge passage 19, and a speed detector 36 positioned adjacent the shaft 12 for outputting a speed signal to the controller commensurate with the rotational speed of the shaft 12. The controller 32 includes an operating mode selector 35 operational for selecting various operating modes as hereinafter described. A timing detector 39 provides an output signal to the controller 32 for determining the timing relationship between the piston bores 13 and the control pockets 21,22.

Figure 3:
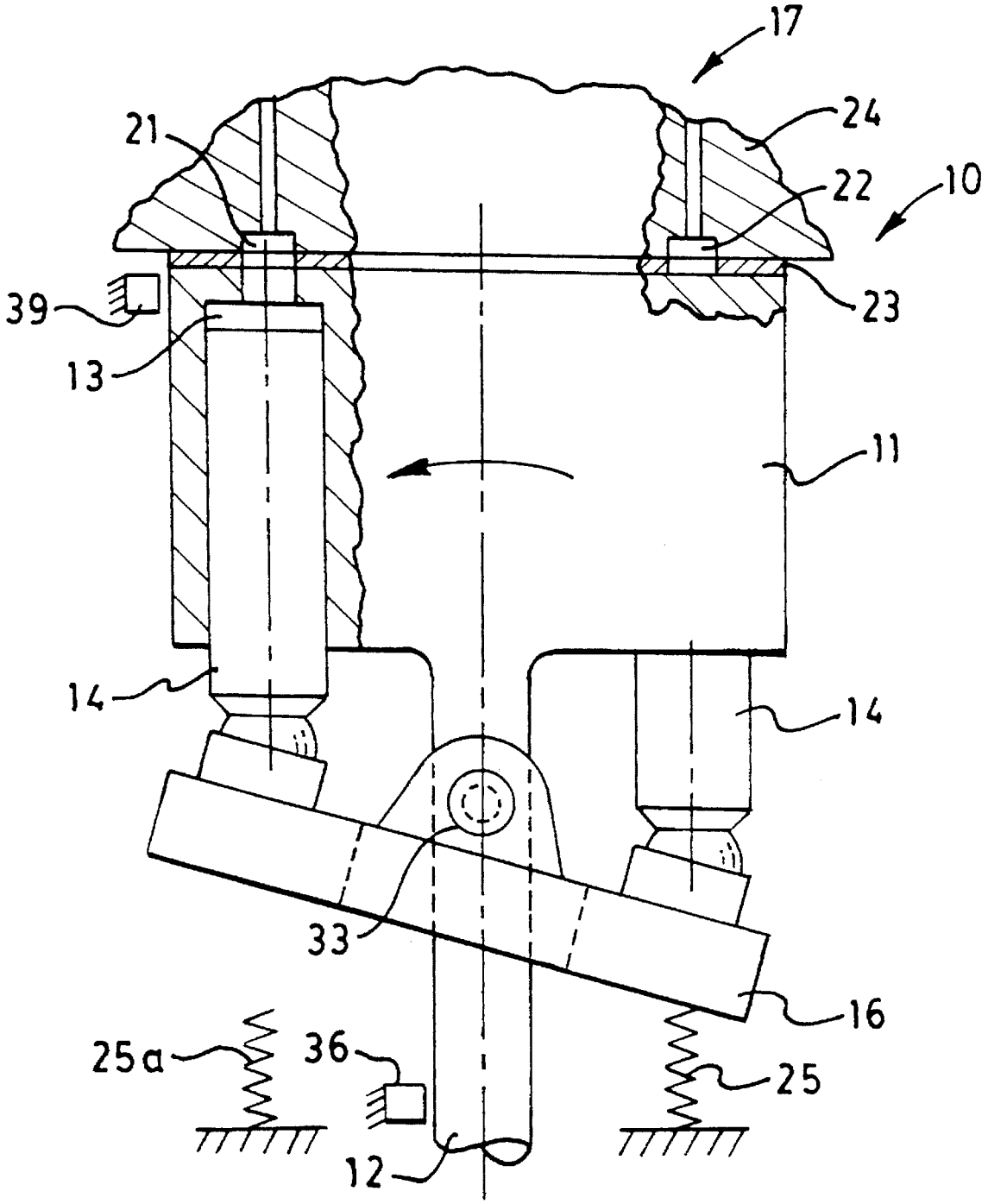
FIG. 3 is a diagrammatic illustration another embodiment of the present invention.
Figure 4:
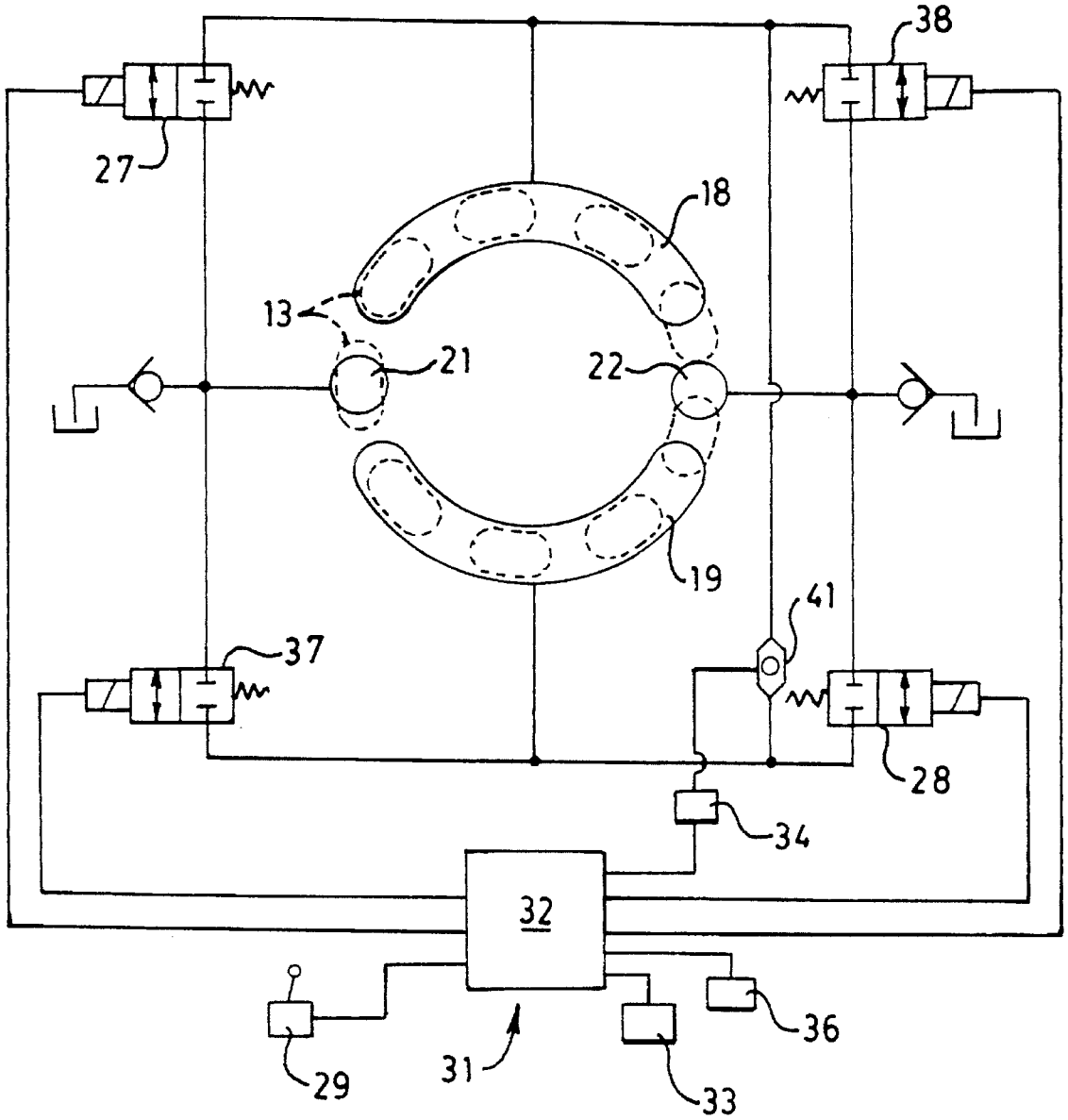
FIG. 4 is a diagrammatic schematic illustration of the embodiment of FIG. 3.

An alternate embodiment of a variable displacement axial piston hydraulic unit 10 of the present invention is disclosed in FIGS. 3 and 4. It is noted that the same reference numerals of the first embodiment are used to designate similarly constructed counterpart elements of this embodiment. In this embodiment, however, the hydraulic unit is a reversible axial piston hydraulic unit in which the swashplate 16 can be moved over center to reverse the direction of flow through the hydraulic unit. Thus, an additional spring **25*a* is provided to work in conjunction with spring 25 for urging the swashplate 26 to its neutral zero displacement position. Moreover, an additional electrohydraulic valve 37 is disposed between the control pocket 21 and the passage 19 to control fluid flow between the control pocket 21 and the passage 19. Yet another electrohydraulic valve 38 is disposed between the control pocket 22 and the passage 18 for controlling fluid flow therebetween. The electrohydraulic valves 37,38 are suitably connected to the controller 32 for receiving control signals therefrom as will hereinafter be described. The pressure detector 34 is connected to the output of a resolver 31 which has its inputs connected to the passage 18,19**.

Industrial Applicability

Figure 2:
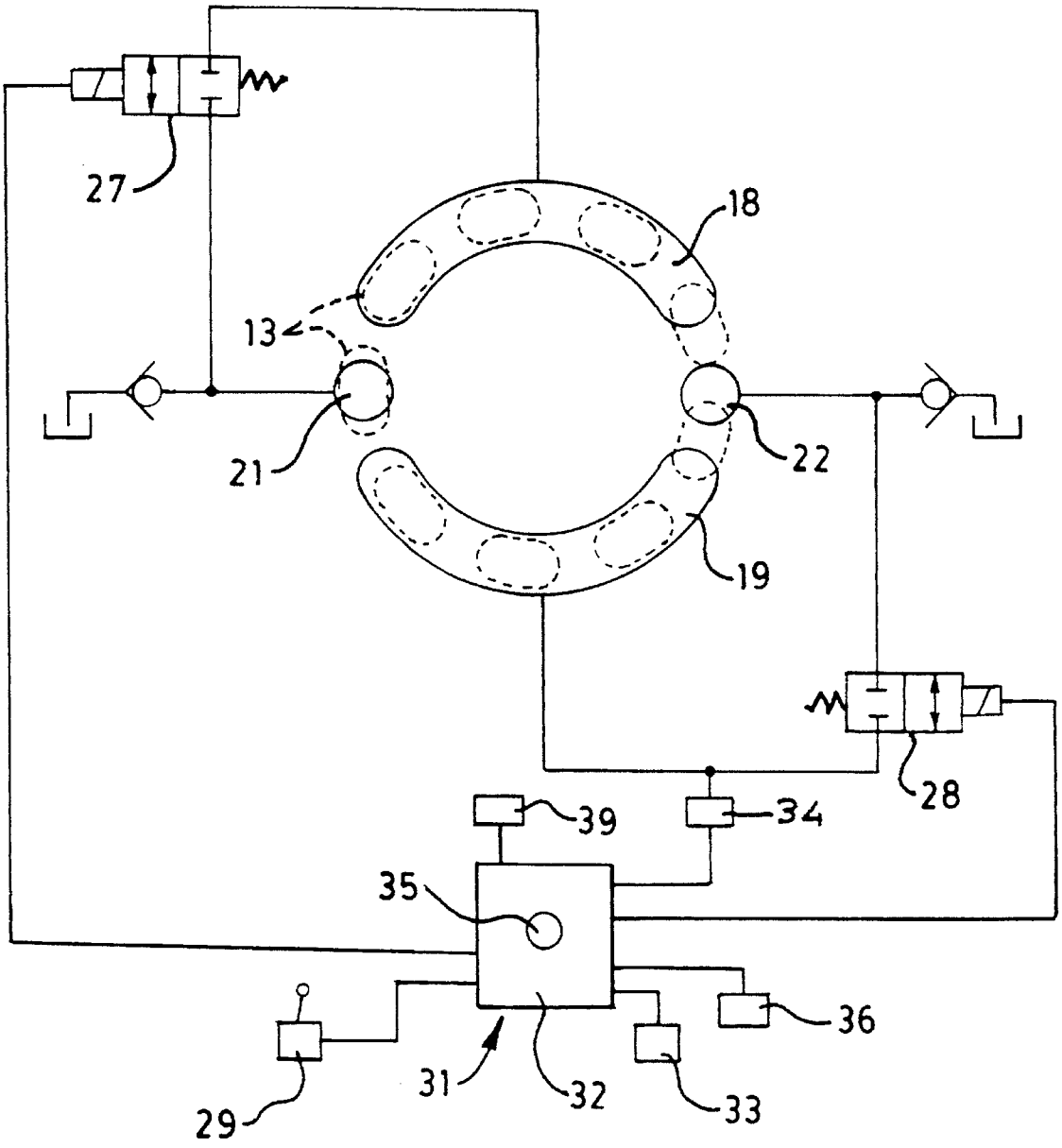
FIG. 2 is a diagrammatic schematic illustration of the embodiment of FIG. 1.

In the use of the hydraulic unit of FIGS. 1 and 2 as a pump, operation is commenced by outputting a command signal from the command signal generator 29 to the controller 32 to establish a desired operating parameter. In one mode of operation, the parameter is a desired flow rate. Thus, the controller processes the command signal and initially outputs appropriate control signals to the electrohydraulic valves 27,28 to control fluid flow from the control pocket 21 to the passage 18 and from the passage 19 to the control pocket 22 to control the pressure in the control pockets. This modifies the inherent torque moment imposed on the swashplate by the pressurized fluid acting on the pistons 14 so that the swashplate tilts in the desired direction. Tilting movement of the swashplate causes an angle signal to be outputted from the angle detector 33 to the controller 32. The controller processes the angle signal to determine when the swashplate reaches an angle at which the pump displacement matches the desired flow rate and then modifies the control signals to the electrohydraulic valves to modulate the flow rate to hold the swashplate at that angle.

The flow rate of the pump is determined by both the tilt angle of the swashplate and the rotational speed of the cylinder barrel 11. When the hydraulic unit is driven by a variable speed power source, such as an internal combustion engine, a rotational speed signal commensurate with the rotational speed of the shaft 12 is outputted from the speed detector 36 and processed by the controller 32 so that both the angle signal and the rotational speed signal are used to determine when the desired flow rate is established.

In another mode of operation, the operating parameter is a predetermined pressure level in the passage 19. Thus, the controller processes the command signal, as described above, so that the swashplate tilts in the desired direction. The controller processes the pressure signal to determine when the swashplate reaches an angle at which the pressure in the passage 19 matches the desired pressure and then modifies the control signals to the electrohydraulic valves to modulate the flow rate therethrough to hold the swashplate at that angle.

The following table shows the operation condition that can be derived from various combinations of the three measured parameters of swashplate tilt angle, rotational speed of the shaft (RPM) and pressure.

| | Operating Condition Derived from Measured Parameters | | | | | |
|---|---|---|---|---|---|---|
| | ANGLE | RPM | PRESS | ANGLE + RPM | ANGLE + PRESS | RPM + PRESS |
| ANGLE | DISPL | FLOW | TORQUE | FLOW | TORQUE | PWR |
| RPM | FLOW | — | — | FLOW | PWR | — |
| PRESS | TORQUE | — | — | PWR | TORQUE | — |
| ANGLE + RPM | FLOW | FLOW | PWR | FLOW | PWR | PWR |
| ANGLE + PRESS | TORQUE | PWR | TORQUE | PWR | TORQUE | PWR |
| RPM + PRESS | PWR | — | — | PWR | PWR | — |

This matrix shows how the three measured parameters are combined to generate a complete control map. RPM is, of course, controlled by the prime mover in the case of a pump but this must be measured to complete the calculations indicated below. The setpoints for the variables can be 1) relative to a fixed internal point, 2) as internally calculated or stored to form a given characteristic, or 3) relative to an externally adjusted value entered into the system. While the external signal in these embodiments are from a manually actuated command signal generator, the external signal can be generated from other external sources, such as associated load, another computer, and so forth.

The FIGS. 3 and 4 embodiment operates essentially like that of FIG. 1 when the swashplate is tilted from its zero displacement position in a first direction at which the passage 18 is the intake passage and the passage 19 is the discharge passage. Under this condition, the electrohydraulic valves 27,28 control the tilt angle of the swashplate. However, when the swashplate is tilted from the zero displacement position in the second direction at which the passage 19 is the intake passage and the passage 18 is the discharge passage, the electrohydraulic valves 37,38 are used in combination to control the tilt angle of the swashplate. More specifically, the electrohydraulic valve 37 controls fluid flow between the control pocket 21 and the passage 19 to control the pressure in the control pocket 21 while the valve 38 controls fluid flow between the passage 18 and the control pocket 22 for controlling the pressure in the control pocket 22. The highest pressure in the passage 18,19 is communicated to the pressure detector 34 through the resolver 41. The assumed direction of rotation in this operation is counterclockwise as viewed in FIG. 4.

Other aspects, objects and advantages of this invention can be obtained from a study of the drawings, the disclosure, and the appended claims.

I claim:

1. A variable displacement axial piston hydraulic unit comprising:

a rotatable cylinder barrel having a plurality of equally spaced, circumferentially arranged piston bores therein;

a plurality of pistons each reciprocating in the respective piston bores;

a swashplate tiltably mounted adjacent one end of the cylinder barrel for adjusting the stroke of the pistons;

a head assembly having first and second arcuate shaped passages and at least one control pocket defined therein disposed between adjacent ends of the first and second passages, the other end of the cylinder barrel being in sliding contact with the head assembly so that each piston bore sequentially communicates with the first passage, the control pocket, and the second passage as the cylinder barrel rotates;

an electrohydraulic valve disposed between the control pocket and one of the first and second passages to control fluid flow therebetween as each piston bore communicates with the control pocket; and control means for outputting a control signal to the electrohydraulic valve in response to receiving a command signal so that the tilt angle of the swashplate is controlled to obtain a desired operating parameter.

2. The hydraulic unit of claim 1, wherein the control means includes a controller for processing the command signal and an angle detector operatively connected to the swashplate for outputting a signal commensurate with the angle of the swashplate, the controller being operative for processing the angle signal to determine when the desired operating parameter has been obtained.

3. The hydraulic unit of claim 2, including a drive shaft for rotating the cylinder barrel, the control means including a speed detector disposed for outputting a speed signal to the controller commensurate with the speed of the drive shaft, the controller being operative for processing the speed signal and modifying the control signal to obtain the desired operating parameter based on the combination of the angle and speed signals.

4. The hydraulic unit of claim 1, wherein the first passage is a low pressure passage and the second passage is a high pressure passage, the control means including a pressure detector for outputting a pressure signal to the controller commensurate with the fluid pressure at the high pressure passage, the controller being operative for processing the pressure signal to determine when the desired operating parameter has been obtained.

5. The hydraulic unit of claim 4, including a drive shaft for rotating the barrel, the control means including a speed detector operatively disposed for outputting a speed signal to the controller commensurate with the speed of the drive shaft, the controller being operative for processing both pressure and speed signals to obtain the desired operating parameter based on the combination of the pressure and speed signals.

6. The hydraulic unit of claim 4, including a drive shaft for rotating the barrel, the control means including a speed detector operatively disposed for outputting a speed signal to the controller commensurate with the speed of the drive shaft, the controller being operative for processing both pressure and speed signals to obtain the desired operating parameter based on the combination of the pressure and speed signals.

7. A variable displacement axial piston hydraulic unit comprising:

a rotatable cylinder barrel having a plurality of equally spaced, circumferentially arranged piston bores therein;

a plurality of pistons each reciprocating in the respective piston bores;

a swashplate tiltably mounted adjacent one end of the cylinder barrel for adjusting the stroke of the pistons;

a head assembly having first and second arcuate shaped passages and first and second control pockets defined therein with each control pocket being respectively disposed between adjacent ends of the first and second passages, the other end of the cylinder barrel being in sliding contact with the head assembly so that each piston bore sequentially communicates with the first passage, the first control pocket, the second passage, and the second control pocket as the cylinder barrel rotates;

a first electrohydraulic valve disposed between the first control pocket and the first passage to control fluid flow therebetween as each piston bore communicates with the first control pocket;

a second electrohydraulic valve disposed between the second control pocket and the second passage to control fluid flow therebetween as each piston bore communicates with the second control pocket; and control means for outputting first and second control signals to the first and second electrohydraulic valves in response to receiving a command signal so that the tilt angle of the swashplate is controlled to obtain a desired operating parameter.

8. The hydraulic unit of claim 7, wherein the control means includes a controller for processing the command signal and an angle detector operatively connected to the swashplate for outputting a signal commensurate with the angle of the swashplate, the controller being operative for processing the angle signal to determine when the desired operating parameter has been obtained.

9. The hydraulic unit of claim 8, including a drive shaft for rotating the cylinder barrel, the control means including a speed detector disposed for outputting a speed signal to the controller commensurate with the speed of the drive shaft, the controller being operative for processing the speed signal and modifying the first and second control signals to obtain the desired operating parameter based on the combination of the angle and speed signals.

10. The hydraulic unit of claim 7, wherein the first passage is a low pressure passage and the second passage is a high pressure passage, the control means including a pressure detector for outputting a pressure signal to the controller commensurate with the fluid pressure at the high pressure passage, the controller being operative for processing the pressure signal to determine when the desired operating parameter has been obtained.

11. The hydraulic unit of claim 6, including a third electrohydraulic valve disposed between the first control pocket and the second passage to control fluid flow therebetween as each piston bore communicates with the first control pocket, and a fourth electrohydraulic valve disposed between the second control pocket and the first passage to control fluid communication therebetween, the control means being operative for outputting third and fourth control signals to control the third and fourth electrohydraulic valves so that the tilt angle of the swashplate is controlled to obtain the desired operating parameter.

12. The hydraulic unit of claim 11, wherein the control means includes a controller for processing the command signal and an angle detector operatively connected to the swashplate for outputting a signal commensurate with the angle of the swashplate, the controller being operative for processing the angle signal to determine when the desired operating parameter has been obtained.

13. The hydraulic unit of claim 12, including a drive shaft for rotating the cylinder barrel, the control means including a speed detector disposed for outputting a speed signal to the controller commensurate with the speed of the drive shaft, the controller being operative for processing the speed signal and modifying the first and second control signals to obtain the desired operating parameter based on the combination of the angle and speed signals.

14. The hydraulic unit of claim 11, wherein the first passage is a low pressure passage and the second passage is a high pressure passage, the control means including a pressure detector for outputting a pressure signal to the controller commensurate with the fluid pressure at the high pressure passage, the controller being operative for processing the pressure signal to determine when the desired operating parameter has been obtained.

15. The hydraulic unit of claim 14, including a drive shaft for rotating the barrel, the control means including a speed detector operatively disposed for outputting a speed signal to the controller commensurate with the speed of the drive shaft, the controller being operative for processing both pressure and speed signals to obtain the desired operating parameter based on the combination of the pressure and speed signals.

16. The hydraulic unit of claim 6 including a command signal generator for outputting the command signal to the control means to establish the desired operating parameter.

* * * * *